US011031736B2

(12) United States Patent
Hashimoto et al.

(10) Patent No.: US 11,031,736 B2
(45) Date of Patent: Jun. 8, 2021

(54) OUTER CONDUCTOR TERMINAL AND SHIELD CONNECTOR

(71) Applicant: Sumitomo Wiring Systems, Ltd., Yokkaichi (JP)

(72) Inventors: Norihito Hashimoto, Yokkaichi (JP); Keisuke Kanemura, Yokkaichi (JP); Motoki Kubota, Yokkaichi (JP); Liping Kang, Yokkaichi (JP); Shohei Mitsui, Yokkaichi (JP); Wataru Yamanaka, Yokkaichi (JP); Masanobu Kasuga, Yokkaichi (JP); Ai Hirano, Yokkaichi (JP); Shinobu Wakahara, Toyota (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/793,519

(22) Filed: Feb. 18, 2020

(65) Prior Publication Data

US 2020/0274298 A1 Aug. 27, 2020

(30) Foreign Application Priority Data

Feb. 27, 2019 (JP) ..... JP2019-033573

(51) Int. Cl.
*H01R 13/6581* (2011.01)
*H01R 13/6594* (2011.01)
*H01R 13/502* (2006.01)

(52) U.S. Cl.
CPC ..... *H01R 13/6581* (2013.01); *H01R 13/6594* (2013.01); *H01R 13/502* (2013.01)

(58) Field of Classification Search
CPC ..... H01R 13/6581; H01R 13/6594; H01R 13/502
USPC ..... 439/607.55
See application file for complete search history.

(56) References Cited

U.S. PATENT DOCUMENTS 7,686,656 B2 * 3/2010 Zheng ..... H01R 13/658 439/660
7,744,426 B2 * 6/2010 Zheng ..... H01R 13/658 439/660
7,841,905 B2 * 11/2010 Zheng ..... H01R 13/658 439/660
7,972,151 B2 * 7/2011 He ..... H01R 13/6471 439/108

(Continued)

FOREIGN PATENT DOCUMENTS

JP 2008-192474 8/2008

*Primary Examiner* — Peter G Leigh
(74) *Attorney, Agent, or Firm* — Gerald E. Hespos; Michael J. Porco; Matthew T. Hespos

(57) ABSTRACT

An outer conductor terminal (22) includes a body (28) surrounding an outer periphery of an inner conductor terminal (21) and having a rear opening and a lid (29) for closing the opening of the body (28). Body-side locks (43) are provided on side surfaces of the body (28). The lid (29) has side portions (52) for covering the side surfaces of the body (28). The side portions (52) are provided with front abutting portions (54) contacting the body-side locks (43) from the front. The lid (29) has rear abutting portions (56) contacting the body-side locks (43) from behind to sandwich the body-side lock portions (43) between the front abutting portions (54) and the rear abutting portions (56) and to hold the lid (29). The body-side locks (43) include contact portions (45) that contact the rear abutting portions (56) with resilient forces.

5 Claims, 10 Drawing Sheets

(56) References Cited

U.S. PATENT DOCUMENTS

| | | | | |
|---|---|---|---|---|
| 8,083,530 | B2 * | 12/2011 | Kobayashi | H01R 13/658 439/79 |
| 8,308,513 | B2 * | 11/2012 | Hsu | H01R 12/724 439/626 |
| 9,673,580 | B2 * | 6/2017 | Yu | H01R 24/62 |
| 9,793,657 | B2 * | 10/2017 | Du | H01R 12/724 |
| 9,806,448 | B2 * | 10/2017 | Yu | H01R 12/724 |
| 10,063,012 | B2 * | 8/2018 | Chang | H01R 13/665 |
| 10,164,378 | B2 * | 12/2018 | Shah | H01R 24/62 |
| 2011/0281449 | A1 * | 11/2011 | Ko | H01R 13/703 439/188 |
| 2011/0281468 | A1 * | 11/2011 | Yu | H01R 12/724 439/660 |
| 2014/0051274 | A1 * | 2/2014 | Yu | H01R 13/7031 439/188 |
| 2014/0051303 | A1 * | 2/2014 | Yu | H01R 13/46 439/660 |
| 2014/0315405 | A1 * | 10/2014 | Yu | H01R 13/7032 439/188 |

* cited by examiner

OUTER CONDUCTOR TERMINAL AND SHIELD CONNECTOR

BACKGROUND

Field of the Invention

The invention relates to an outer conductor terminal and a shield connector.

Related Art

Japanese Unexamined Patent Publication No. 2008-192474 discloses a shield terminal including an inner conductor terminal, an outer conductor terminal surrounding the outer periphery of the inner conductor terminal and a dielectric interposed between the outer conductor terminal and the inner conductor terminal. The shield terminal is accommodated into a connector housing. The outer conductor terminal is composed of an outer conductor terminal body covering the inner conductor terminal and a lid for closing an opening on a back surface of the outer conductor terminal body. The outer conductor terminal body includes board mounting tabs projecting down on four corners. The lid is fit externally on a rear part of the outer conductor terminal body.

It is preferable to provide a locking structure between the outer conductor terminal body and the lid to reliably maintain a box shape of the outer conductor terminal. Consideration has been given to cutting and raising a side surface of the outer conductor terminal body to form a lock projection and forming a lock hole in a side part of the lid for receiving the lock projection. However, a shielding property can be impaired by the cut and raised lock projection and by a bored part such as the lock hole in the outer conductor terminal. Further, in the case of connecting the lid to a circuit board, a return current corresponding to an electrical signal of the inner conductor terminal may not flow smoothly from the outer conductor terminal body to the lid unless a contact point between the lock projection and the lock hole is established reliably.

The invention was completed on the basis of the above situation and aims to provide an outer conductor terminal capable of improving electrical connection reliability between a lid and a body and to provide a shield connector using the outer conductor terminal.

SUMMARY

The invention is directed to an outer conductor terminal with a body surrounding an outer periphery of an inner conductor terminal. The body has an opening in a rear surface and a lid for closing the opening of the body. A body-side lock is provided on a side surface of the body. The lid has a side portion to cover the side surface of the body. The side portion has a front abutting portion that contacts the body-side lock from the front and a rear abutting portion that contacts the body-side lock from behind to sandwich the body-side lock between the front abutting portion and the rear abutting portion and to hold the lid in a closed state. At least one of the body-side lock and the rear abutting portion contact each other with a resilient force.

The lid is held in the closed state with respect to the body by sandwiching the body-side lock between the front and rear abutting portions. Additionally, at least one of the body-side lock and the rear abutting portion contacts the other with the resilient force. Thus, a connected state of the body-side lock and the rear abutting portion is maintained reliably and a connected state of the body-side lock and the front abutting portion also is maintained reliably. As a result, electrical connection reliability between the lid and the body can be improved.

The body-side lock may include a side plate arranged along a front-rear direction and a contact portion connected to a rear end of the side plate. The contact portion may be bent with respect to the front-rear direction and configured to contact a plate surface of the rear abutting portion. According to this configuration, the body-side lock is connected more reliably to the rear abutting portion via the contact. Further, the body-side lock need not have a particularly complicated shape.

Plural contact portions may be branched to project from a base end on a rear of the side plate. According to this configuration, the body-side lock is connected even more reliably to the rear abutting portion via the contacts.

A shield connector may include a shield terminal including the above-described outer conductor terminal, an inner conductor terminal and a dielectric interposed between the outer conductor terminal and the inner conductor terminal, and a connector housing for accommodating the shield terminal. A good shielding property of the outer conductor terminal can be realized, as described above. Thus, this shield connector is suitable for use, for example, as a shield connector for high-speed communication of an automotive vehicle.

DETAILED DESCRIPTION

Figure 9:
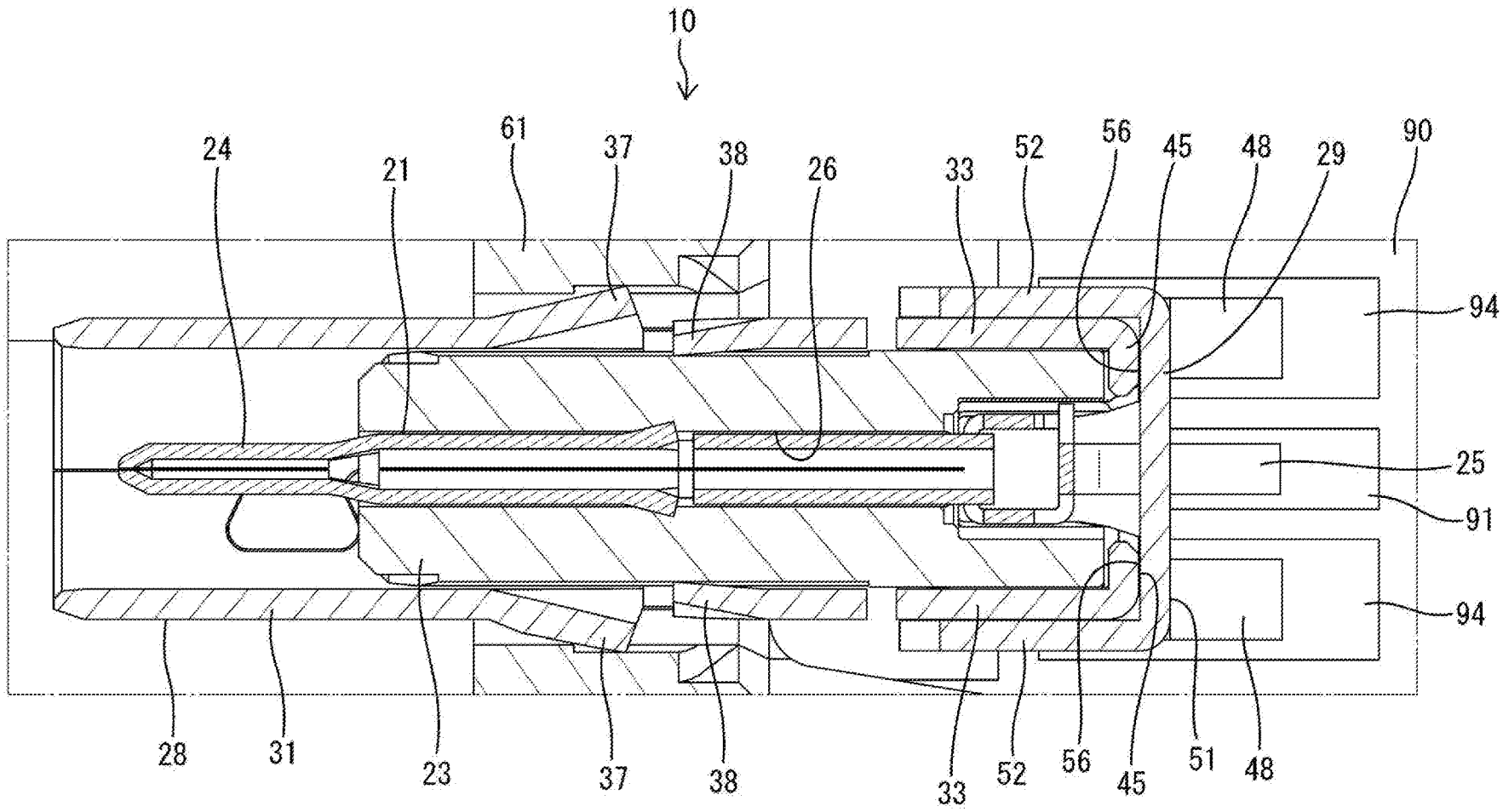
FIG. 9 is a plan view in section of a mounting part of the outer conductor terminal in the shield connector.
Figure 10:
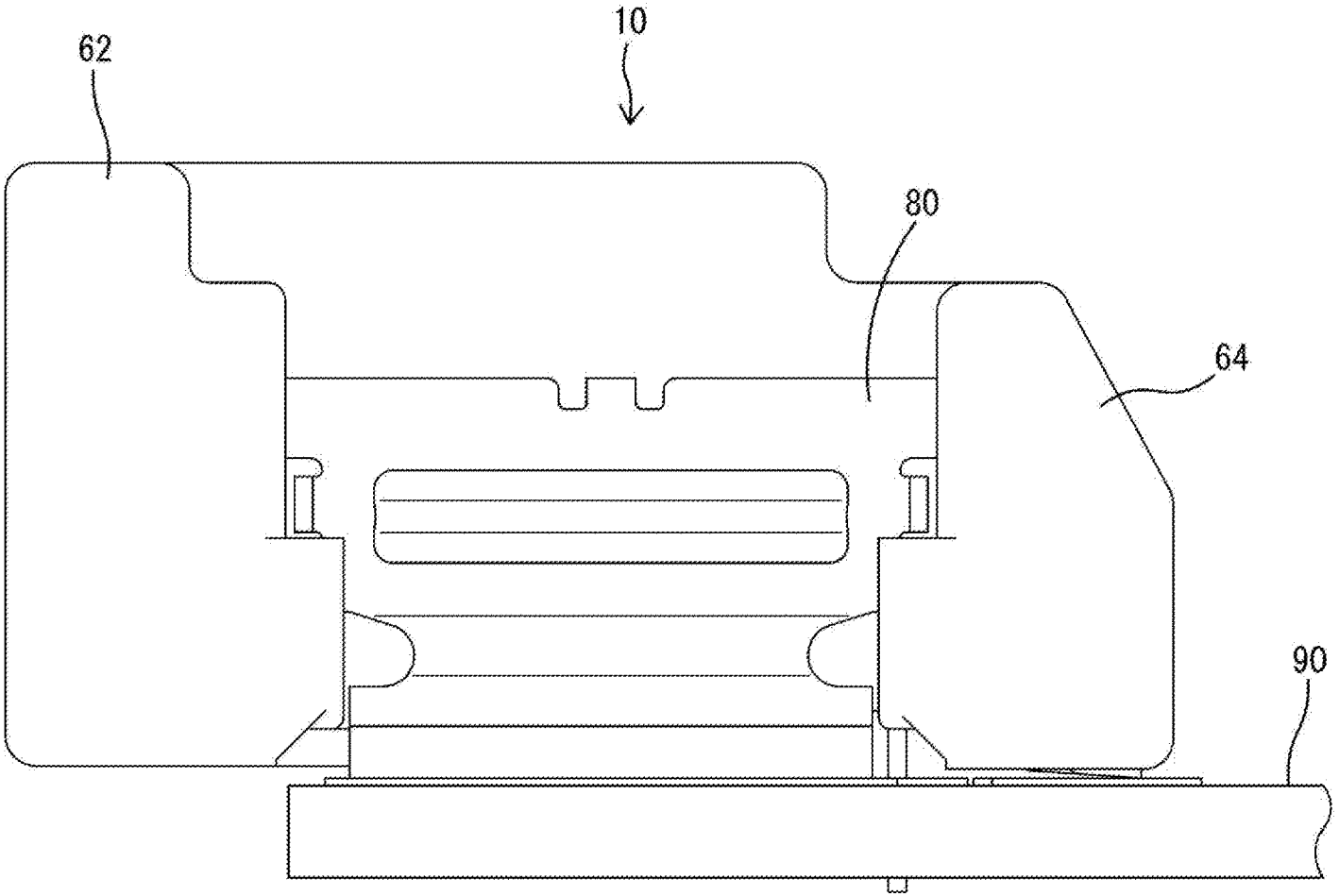
FIG. 10 is a side view of the shield connector.

One embodiment of the invention is described with reference to FIGS. 1 to 10. A shield connector 10 of this embodiment is installed in an unillustrated automotive vehicle and is used in high-speed communication between in-vehicle electrical components. In the following description, a left side of FIGS. 8 to 10 is referred to as a front concerning a front-rear direction and upper and lower sides are based on a vertical direction of FIG. 8.

Figure 8:
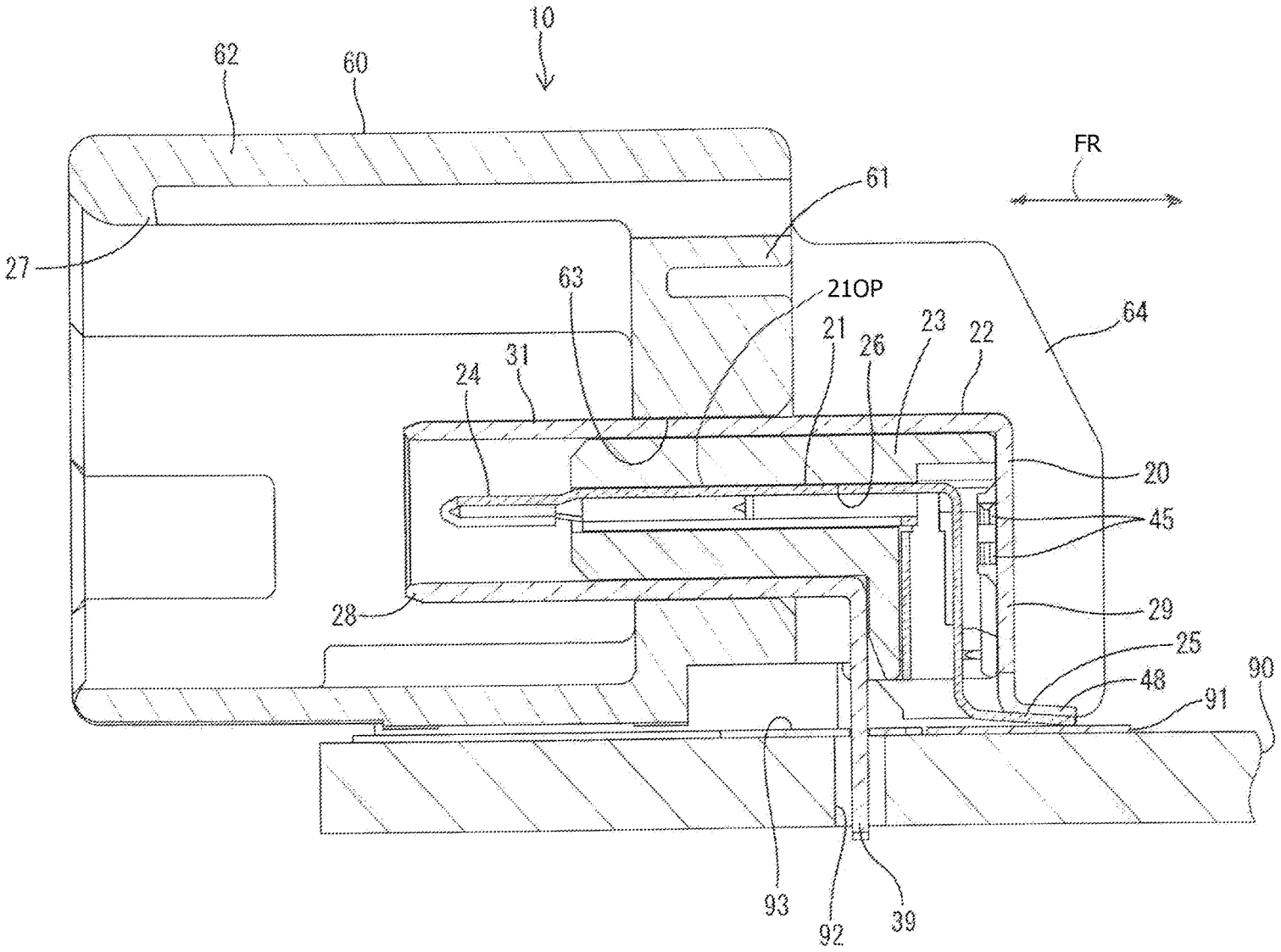
FIG. 8 is a side view in section of a shield connector.

As shown in FIG. 8, the shield connector 10 includes a shield terminal 20 and a connector housing 60 for accommodating the shield terminal 20. The shield terminal 20 includes an inner conductor terminal 21, an outer conductor terminal 22 surrounding the outer periphery of the inner conductor terminal 21 and a dielectric 23 interposed between the outer conductor terminal 22 and the inner conductor terminal 21.

The inner conductor terminal 21 is formed, such as by bending a conductive metal plate. As shown in FIGS. 8 and 9, a tab 24 projects forward on the inner conductor terminal 21 and is connected electrically to an unillustrated mating terminal fitting in an unillustrated mating connector when the shield connector 10 is connected to the mating connector. A rear part of the inner conductor terminal 21 includes an inner conductor connecting piece 25 bent down and rearward. A rearward extending part of the inner conductor connecting piece 25 contacts a conductive portion 91 on a surface of a circuit board 90 and is connected electrically for signal transmission. The inner conductor terminal 21 further includes an outer periphery 21OP extending along a front-rear direction FR.

The dielectric 23 is formed of an insulating synthetic resin material having a predetermined dielectric constant and a terminal accommodation chamber 26 penetrates the dielectric 23 in the front-rear direction. The inner conductor terminal 21 is accommodated in the terminal accommodation chamber 26. The inner conductor terminal 21 is held in the dielectric 23 with the tab 24 projecting forward through a front end opening of the terminal accommodation chamber 26. The dielectric 23 insulates the inner conductor terminal 21 and the outer conductor terminal 22 from each other.

The connector housing 60 is made of synthetic resin and includes, as shown in FIG. 8, a base wall 61 substantially along the vertical direction and a rectangular tubular receptacle 62 projects forward from the outer periphery of the base wall 61. The connector housing 60 includes two side walls 64 (only one is shown in FIGS. 8 and 10) projecting rearward from both left and right sides of the base wall 61. Fixing members 80 are mounted on parts of both left and right outer side surfaces of the connector housing 60 straddling over the receptacle 62 and the side walls 64 (only one is shown in FIG. 10). The fixing members 80 are plates made of metal and have an L-shaped cross-section. Vertical parts of the fixing members 80 are mounted on the connector housing 60 and lateral parts thereof along are arranged along the surface of the circuit board 90 and connected to the circuit board 90. The connector housing 60 is fixed to the circuit board 90 via the fixing members 80.

As shown in FIG. 8, the receptacle 62 includes a housing lock 27 on the inner surface of an upper wall. The unillustrated mating connector is fit into the receptacle 62. The housing lock 27 holds the connectors in a connected state by locking the mating connector in the receptacle 62. A substantially circular mounting hole 63 penetrates through the base wall 61 in the front-rear direction (wall thickness direction), and the outer conductor terminal 22 is inserted through the mounting hole 63 of the base wall 61 in the front-rear direction.

Figure 1:
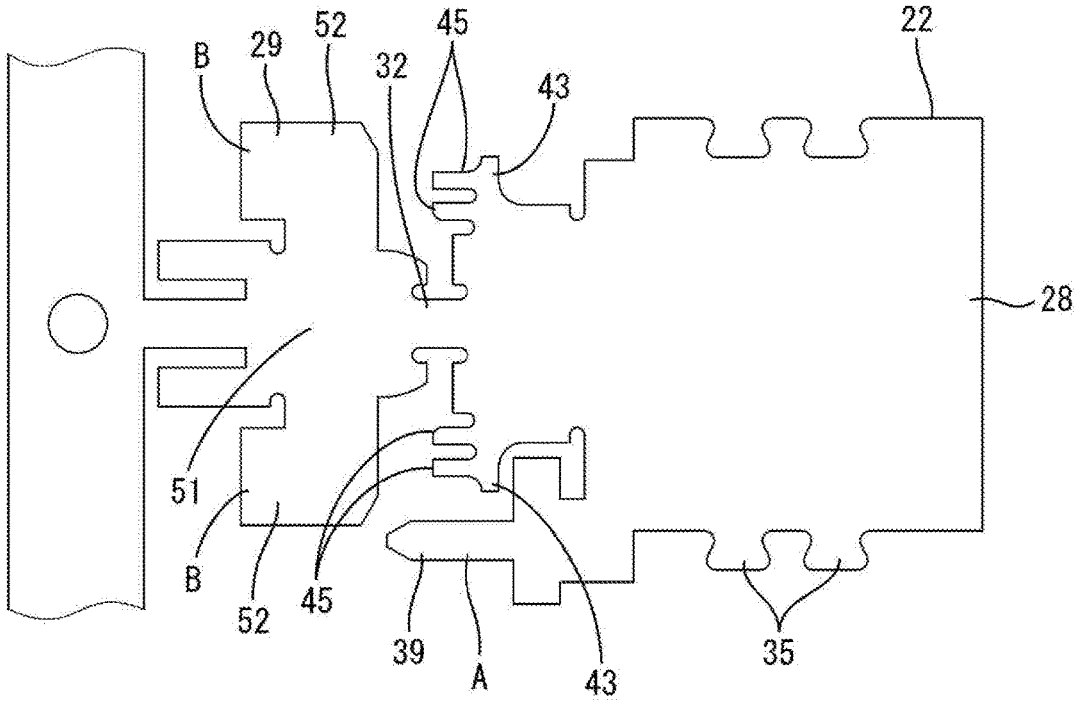
FIG. 1 is a development of an outer conductor terminal of one embodiment of the invention.
Figure 2:
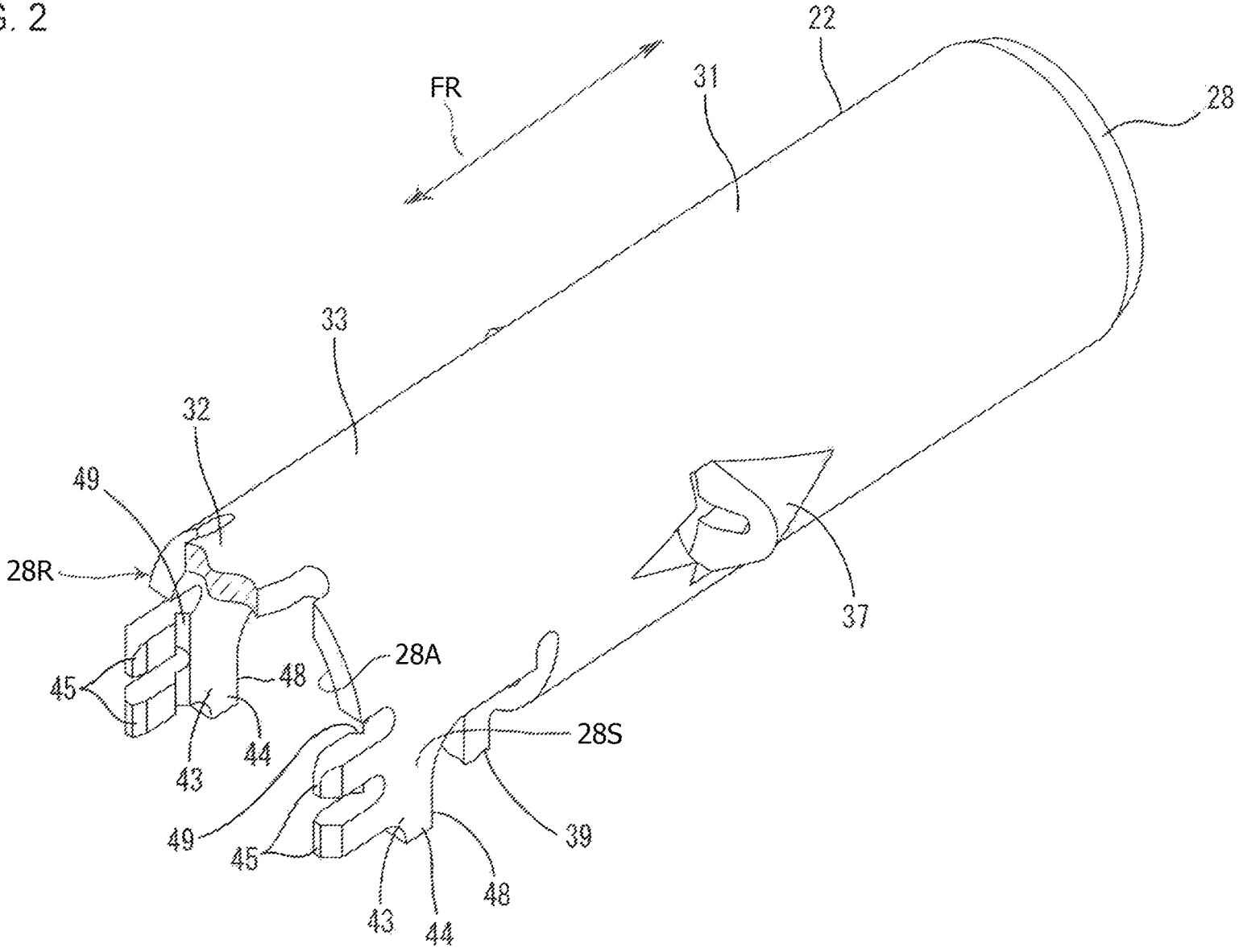
FIG. 2 is a perspective view partly in section showing a state before contact portions are bent in the process of manufacturing the outer conductor terminal.
Figure 4:
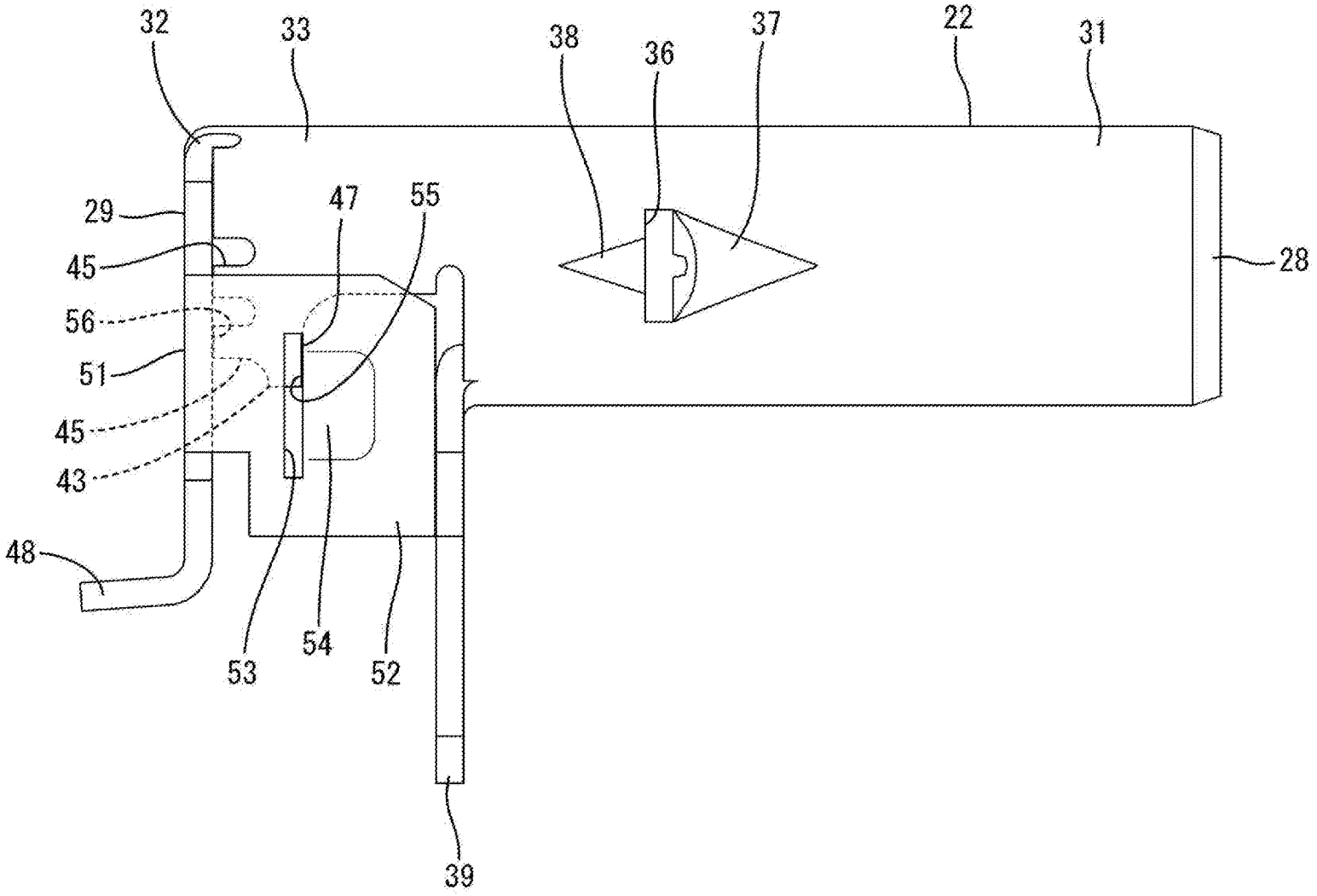
FIG. 4 is a side view of the outer conductor terminal.
Figure 5:
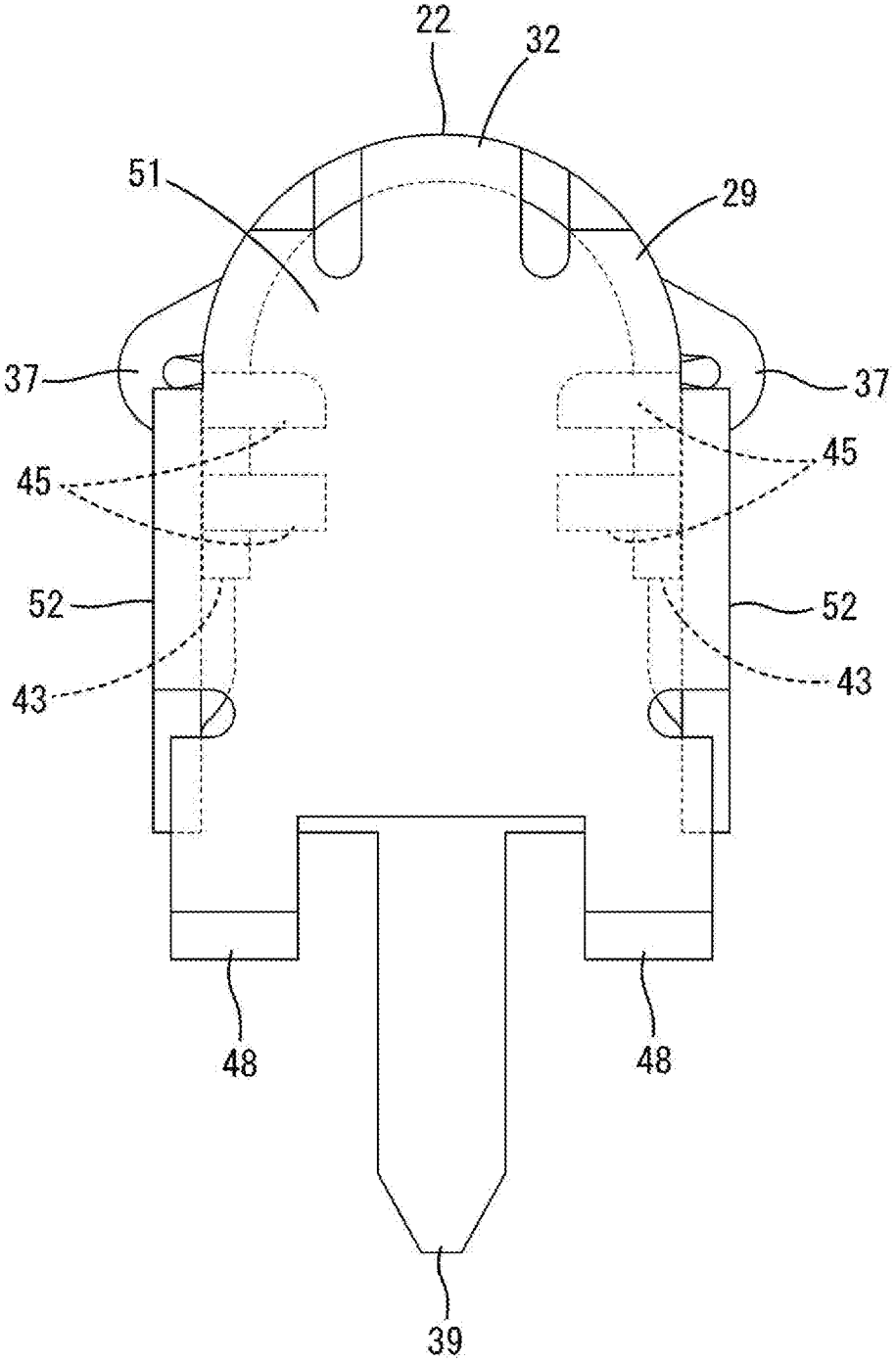
FIG. 5 is a back view of the outer conductor terminal.
Figure 7:
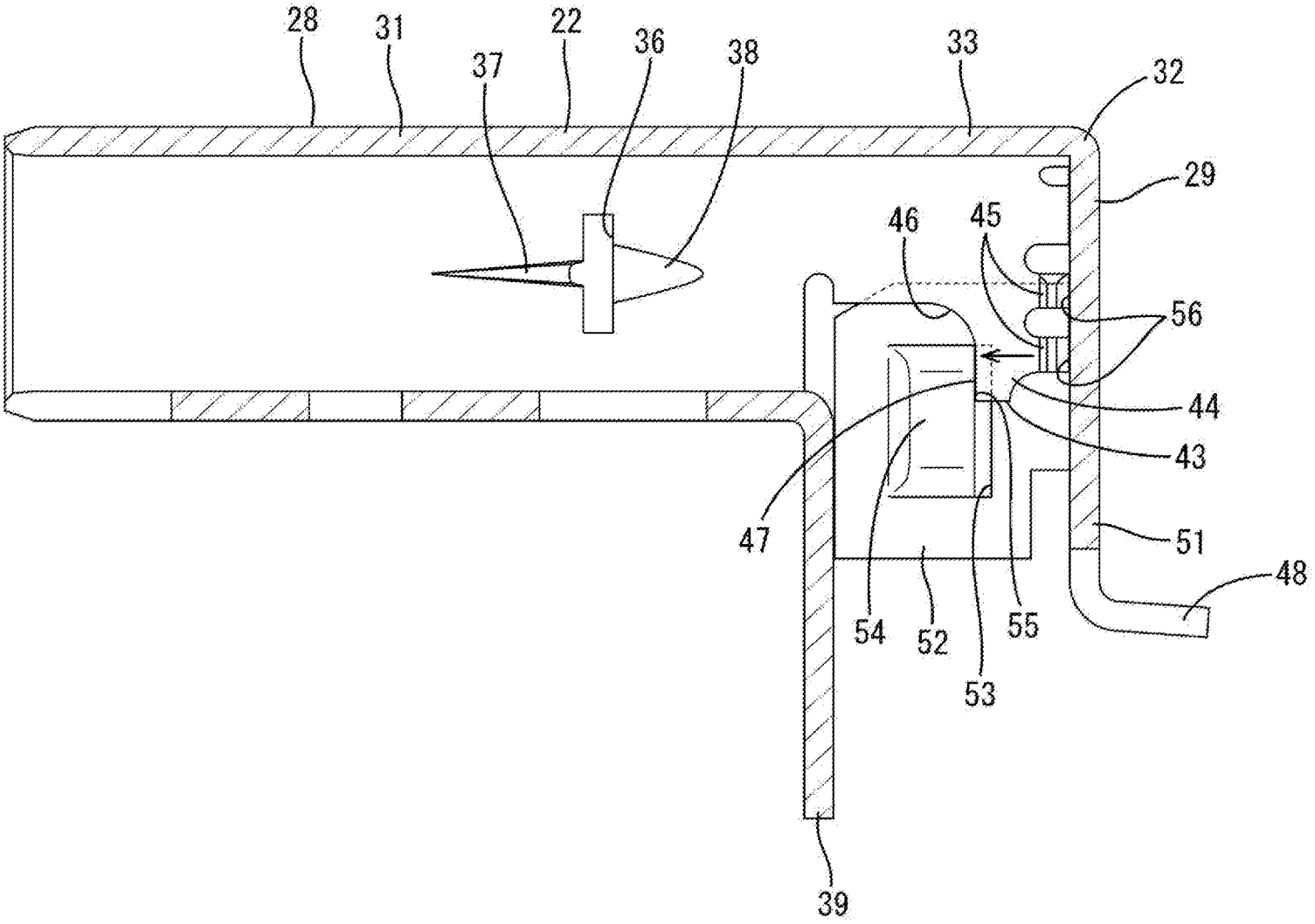
FIG. 7 is a section along X-X of FIG. 6.

The outer conductor terminal 22 is formed by applying bending and the like to a conductive metal plate stamped into a developed shape shown in FIG. 1. As shown in FIGS. 4 and 7, the outer conductor terminal 22 includes a tubular body 28 having an axis extending along the front-rear direction FR. The tubular body 28 has a side surface 28S and a rear end 28R with an opening 28A, as shown in FIG. 2. A lid 29 in the form of a flat plate is coupled to the rear end of the body 28 via a hinge 32 and can be rotated to open or close the opening 28A.

The body 28 includes a hollow cylindrical tubular portion 31 and a coupling 33 having an arcuate cross-section, connected to a rear end upper part of the tubular portion 31 and continuous with an upper part of the body 28 without any step.

Figure 3:
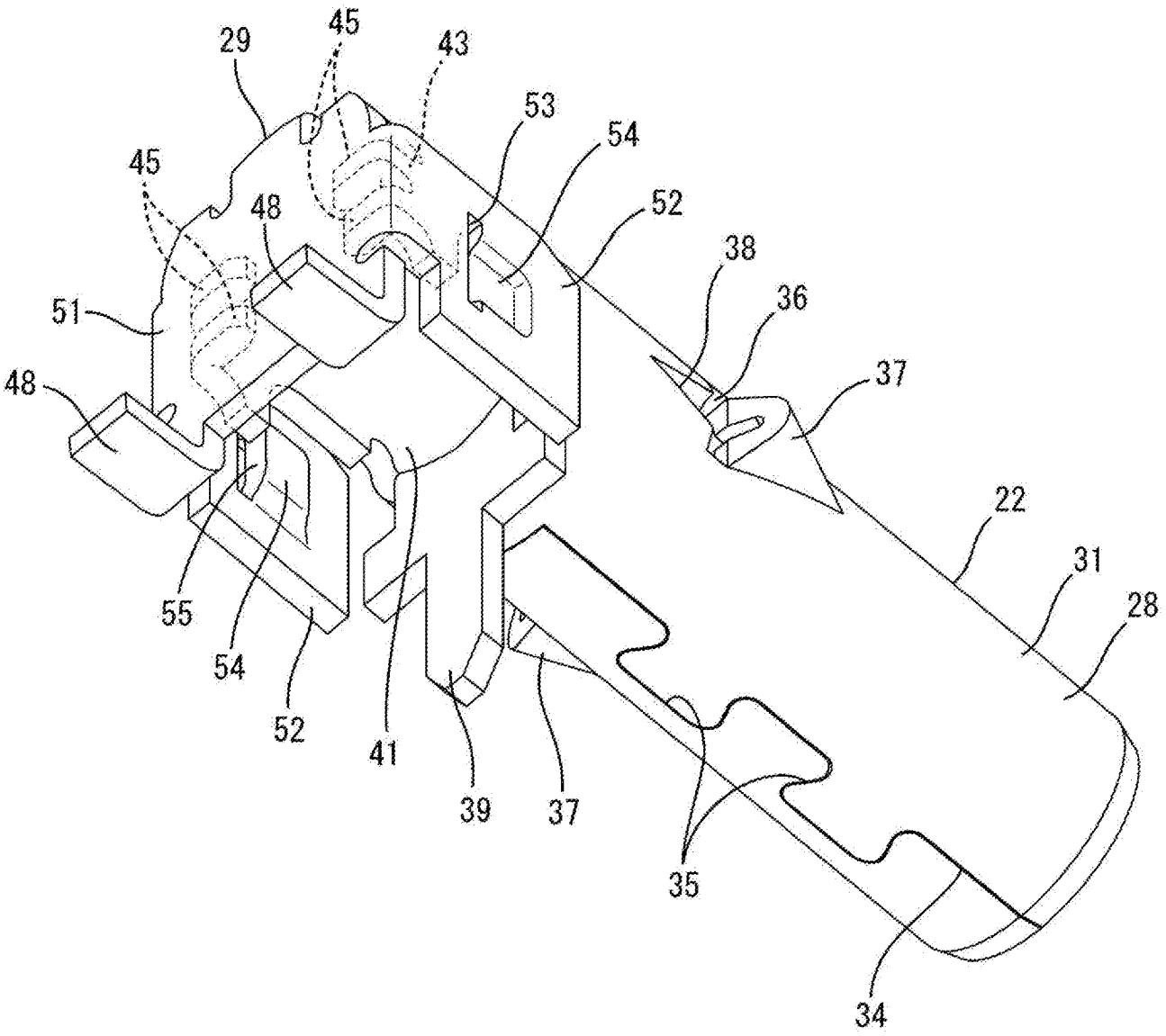
FIG. 3 is a perspective view of the outer conductor terminal viewed from below.
Figure 6:
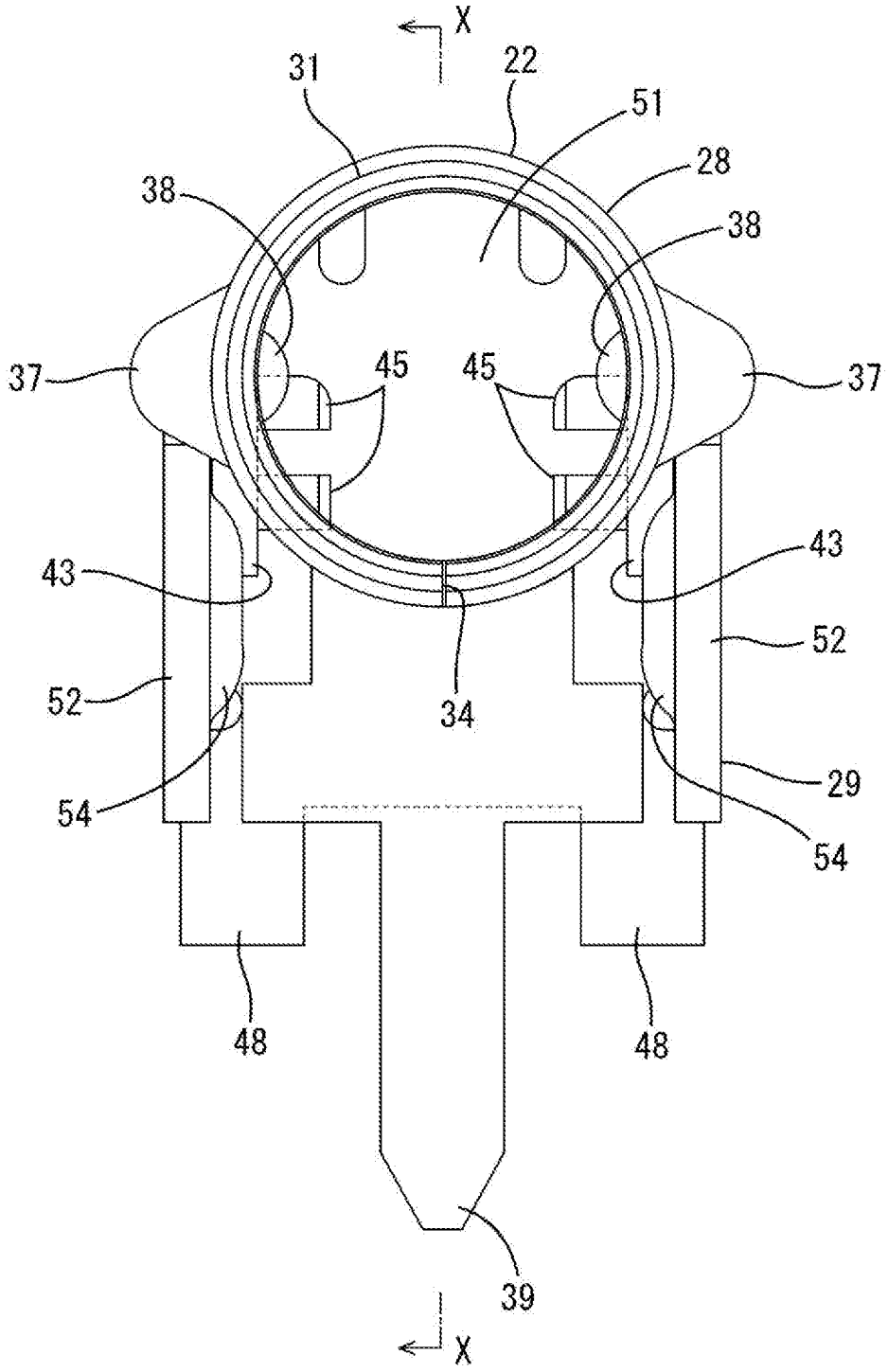
FIG. 6 is a front view of the outer conductor terminal.

As shown in FIGS. 3 and 6, the tubular portion 31 includes butting ends 34 in a lateral center of a lower end. As shown in FIG. 3, projections and recesses 35 are provided side by side in the front-rear direction on the butting ends 34 of the tubular portion 31. The tubular portion 31 is maintained in the hollow cylindrical shape by the engagement of the projections and the recesses 35.

The tubular portion 31 includes two body-side slits 36 (only one is shown in FIGS. 4 and 7) having a linear opening along the vertical direction in vertical centers of both left and right sides, two outer locks 37 to be locked to the connector housing 60 on a front side, and two inner locks 38 to be locked to the dielectric 23 on the rear side. The outer locks 37 are formed by bending and raising side wall parts of the tubular portion 31 outward via the body-side slits 36 and form of claws that are substantially triangular in a side view. As shown in FIG. 9, the outer conductor terminal 22 passed through the mounting hole 63 is held in the connector housing 60 by the outer locks 37 locking the base wall 61. With the outer conductor terminal 22 held in the connector housing 60, a front part of the tubular portion 31 projects into the receptacle 62 and a rear part of the body 28 and the lid 29 are exposed rearwardly of the base wall 61, as shown in FIGS. 8 and 9. The rear part of the body 28 and the lid 29 are protected by having both left and right sides covered by the side walls 64.

The inner locks 38 are formed by bending and raising side wall parts of the tubular portion 31 inward via the body-side slits 36, and are in the form of claws that are substantially triangular in a side view. As shown in FIG. 9, the dielectric 23 is held in the tubular portion 31 by the inner locks 38 locking the dielectric 23.

As shown in FIGS. 3 and 6, the tubular portion 31 includes a tab-like body-side connecting piece 39 projecting down in a laterally central part of the lower end. The body-side connecting piece 39 is formed by bending down a tongue (see part A of FIG. 1) that extends rearward in the developed shape. As shown in FIG. 8, the body-side connecting piece 39 is inserted into a through hole 92 of the circuit board 90 and is connected electrically to a first ground 93 formed on the surface of the circuit board 90.

The body 28 includes a pull-out opening 41 (see FIG. 3) behind the tubular portion 31 and below the coupling 33. The inner conductor connecting piece 25 is pulled out through the pull-out opening 41 and toward the circuit board 90. The body-side connecting piece 39 is arranged so that a rear plate surface faces the pull-out opening 41.

As shown in FIG. 2, two body-side locks 43 project down on lower parts of both left and right sides (both circumferential end parts) of the coupling 33.

Each of the body-side locks 43 includes a side plate 44 arranged such that plate surfaces thereof extend along the front-rear direction, and contacts 45 project rearward of each side plate 44. As shown in FIG. 7, a plate thickness part on the front end of the side plate 44 is composed of a curved end 46 and a front abutted portion 47. The curved end 46 is arcuate in a side view and continuous from a front lower end of the coupling 33. The front abutted portion 47 is continuous from the curved end 46 and is substantially vertical. The front abutted portion 47 can contact a front abutting portion 54 of a side portion 52 to be described later.

As shown in FIG. 2, a plate thickness part on the rear end of the side plate 44 is retracted slightly forward from the rear end of the coupling 33. The contacts 45 are pin-like parts having substantially rectangular cross-sections and are connected at two positions spaced apart in the vertical direction on the plate thickness part on the rear end of the side plate 44, continuous from the plate thickness part of the rear surface of the side plate 44 and formed by being bent inward in a plate thickness direction (toward the pull-out opening 41) after projecting slightly rearward (see FIG. 3). The contacts 45 are arranged in pairs in the vertical and lateral directions on both body-side locks 43. Inner and outer plate surfaces on a tip part of each contact 45 are chamfered into a tapered shape. As shown in FIG. 2, each contact 45 includes a recessed groove 49 having a V-shaped cross-section on an inner surface, and the recessed groove 49 serves as a bending start point. The recessed groove 49 is formed along the vertical direction on a base end of each contact portion 45.

The hinge 32 is a narrow flexible link between the coupling 33 and the lid 29.

The lid 29 is rotationally displaceable between an open state where the hinge 32 extends straight to open a rear side of the pull-out opening 41 and a closed state where the hinge 32 is curved and bent to close the rear side of the pull-out opening 41. As shown in FIGS. 3 to 7, the lid 29 includes a back plate 51 serving as a rear part and two sides 52.

The back plate 51 is rectangular in a back view and, as shown in FIGS. 4 and 7, is arranged vertically in the closed state to close an opening at the rear of the body 28. Two lid-side connecting pieces 48 project down from a lower end (in the closed state) of the back plate 51. As shown in FIG. 4, the lid-side connecting pieces 48 are substantially L-shaped in a side view and include parts extending rearward after hanging down toward the circuit board 90 from both left and right sides of the lower end of the back plate 51 in the closed state. As shown in FIG. 9, rearward extending parts of the lid-side connecting pieces 48 are arranged along the circuit board 90 and electrically connected to second ground s 94 formed on the surface of the circuit board 90.

Each side portion 52 is formed by bending plate-like parts (see parts B of FIG. 1) laterally protruding from both left and right ends of the back plate 51 forwardly, and is arranged in the closed state so that the plate surfaces extend along the front-rear direction and cover the corresponding body-side locks 43 from outside (see FIGS. 3 to 7).

As shown in FIGS. 3, 4 and 7, the side portion 52 includes a lid-side slit 55 having a linear opening along the vertical direction in the closed state in a substantially central part and the front abutting portion 54 on a front side. The front abutting portion 54 is bent and raised inward (toward the pull-out opening 41 in the closed state) via the lid-side slit 53 and is in the form of a flat base having a rectangular shape in a side view. A plate thickness part of a rear end facing the lid-side slit 53 serves as a locking edge 55 arranged along the vertical direction.

The back plate 51 includes rear abutting portions 56 capable of coming into contact with the respective contact portions 45 at positions of both left and right ends of the front surface facing the locking edges 55 of the front abutting portions 54 from behind (see FIGS. 7 and 9). The rear abutting portions 56 are plate surfaces continuous with surrounding regions without any step on the front surface of the back plate 51 and have no special shape.

Next, functions of this embodiment are described.

First, the outer conductor terminal 22 is inserted into the mounting hole 63 of the base wall 61 of the connector housing 60. At this time, the lid 29 is in the open state and each contact 45 is in a straight state before being bent.

Subsequently, the dielectric 23 is inserted into the outer conductor terminal 22 from behind, and the inner conductor terminal 21 then is inserted into the terminal accommodation chamber 26 of the dielectric 23. Thereafter, each contact 45 is bent via the recessed groove 49. In that state, the lid 29 is rotated to the closed state via the hinge 32. In the process of displacing the lid 29 to the closed state, the front abutting portions 54 of the side portions 52 interfere with the corresponding body-side locks 43 and the side portions 52 are expanded and deformed resiliently with parts coupled to the back plate 51 as fulcrums.

When the lid 29 reaches the closed state, the opening in the rear surface of the body 28 is closed by the back plate 51, the front abutting portions 54 of both side portions 52 ride over the body-side locks 43 and the side portions 52 resiliently return to cover the corresponding body-side locks 43 from outside. Further, when the lid 29 reaches the closed state, front lower end parts of the body-side locks 43 enter upper parts of the lid-side slits 53 of the side portions 52 and the locking edges 55 of the front abutting portions 54 come into contact with the front abutted portions 47 of the body-side locks 43 along the vertical direction, as shown in FIGS. 4 and 7. Simultaneously, the rear abutting portions 56 of the back plate 51 contact tip parts (parts closer to tips than bent parts) of the upper and lower contacts 45 along the lateral direction. Thus, the plate surface of each contact 45 outside the bend contacts along the rear abutting portion 56 with each contact 45 slightly resiliently deformed with a base end thereof connected to the side plate 44 as a fulcrum. Accordingly, the respective contacts 45 generate resilient forces (resilient reaction forces) while being held in contact with the rear abutting portions 56 and bias the body-side locks 43 in an acting direction (arrow direction of FIG. 7) of the resilient forces. Therefore, the front abutted portions 47 of the body-side locks 43 are pressed into contact with the locking edges 55 of the front abutting portions 54. As a result, the body-side locks 43 are sandwiched tightly between the locking edges 55 of the front abutting portions 54 and the rear abutting portions 56 without any clearance in the front-rear direction.

Thereafter, the shield connector 10 is placed on the surface of the circuit board 90, and reflow soldering is applied to fix the shield connector 10 to the circuit board 90 via the fixing members 80. Further, the inner conductor connecting piece 25 is connected to the conductive portion 91 of the circuit board 90 by reflow soldering, the body-side connecting piece 39 is inserted into the connection hole 92 of the circuit board 90 and connected to the first ground 93, and the lid-side connecting pieces 48 are connected to the second grounds 94 of the circuit board 90 (see FIGS. 8 and 9).

When an electrical signal flows in the inner conductor terminal 21, a return current corresponding to the electrical signal is generated in the outer conductor terminal 22. A part of the return current flows from the body 28 to the lid 29 along the inner surface of the outer conductor terminal 22 and is dropped to the first and second grounds 93, 94 of the circuit board 90 from the lid 29 via the body-side connecting piece 39 and the lid-side connecting pieces 48.

The body-side locks 43 are in contact with the rear abutting portions 56 of the back plate 51 while applying the resilient forces of the respective contact portions 45 to the rear abutting portions 56. Thus, a connected state of the body-side locks 43 and the back plate 51 is held reliably and a connected state of the body-side locks 43 and the side portions 52 also is held reliably. As a result, the flow of the return current is not interrupted between the body 28 and the lid 29 and electrical connection reliability between the lid 29 and the body 28 is enhanced.

Further, since the respective contacts 45 project in a forked manner from base end parts on the rear end sides of the side plates 44, the body-side locks 43 are connected more reliably to the rear abutting portions 56 via the contacts 45.

Other embodiments are briefly described below.

Although the hinge is interposed between the lid and the body in the above embodiment, the hinge may not be provided and the lid and the body may be configured as dividable separate bodies. In this case, the lid may be held integrally with the body with the opening in the rear surface of the body closed by sandwiching the body-side locks between the front abutting portions and the rear abutting portions.

Although the contact portions are provided on the body-side locks in the above embodiment, the contact portions may be provided on the rear abutting portions of the lid. For example, the rear abutting portions may project from the back plate and contacts on projecting ends of the rear abutting portions may contact rear ends of the body-side locks with resilient forces.

Although the contact portions are provided on the body-side locks in the above embodiment, the contact portions may be provided on both the body-side locks and the rear abutting portions of the lid in the case of the present invention.

Although two contact portions are branched from the base of the rear end of the side plate in the above embodiment, a contact in the form of a single plate may be formed on the base on the rear of the side plate without being branched.

Although two contacts are branched from the base on the rear of the side plate in the above embodiment, three or more contacts may be branched from the base on the rear of the side plate.

Although the rear abutting portions are provided on the back plate of the lid in the above embodiment, the rear abutting portions may be provided on the side parts of the lid.

LIST OF REFERENCE SIGNS

10 . . . shield connector
20 . . . shield terminal
21 . . . inner conductor terminal
22 . . . outer conductor terminal
23 . . . dielectric
28 . . . body
29 . . . lid
43 . . . body-side lock
44 . . . side plate
45 . . . contact
51 . . . back plate
52 . . . side portion
54 . . . front abutting portion
56 . . . rear abutting portion
60 . . . connector housing

What is claimed is:

1. An outer conductor terminal, comprising:

a body surrounding an outer periphery of an inner conductor terminal, the body having a rear end with an opening and having a side surface with a body-side lock;

a lid having a back plate hinged to the body for closing the opening of the body;

a side plate projecting forward from the back plate of the lid to cover the side surface of the body;

a front abutting portion bulging inward on the side plate of the lid, the front abutting portion contacting the body-side lock from the front; and a rear abutting portion on a front surface of the back plate of the lid, the rear abutting portion contacting the body-side lock from behind to sandwich the body-side lock between the front abutting portion and the rear abutting portion and to hold the lid in a closed state, at least one of the body-side lock and the rear abutting portion contacting the other with a resilient force.

2. An outer conductor terminal, comprising:

a body surrounding an outer periphery of an inner conductor terminal, the body having an opening in a rear surface;

a lid for closing the opening of the body;

a body-side lock provided on a side surface of the body;

a side portion provided on the lid to cover the side surface of the body;

a front abutting portion on the side portion, the front abutting portion contacting the body-side lock from the front; and a rear abutting portion on the lid, the rear abutting portion contacting the body-side lock from behind to sandwich the body-side lock between the front abutting portion and the rear abutting portion and hold the lid in a closed state, at least one of the body-side lock and the rear abutting portion contacting the other with a resilient force, wherein the body-side lock includes a side plate arranged along a front-rear direction and a contact connected to a rear end of the side plate, bent with respect to the front-rear direction and configured to contact a plate surface of the rear abutting portion.

3. The outer conductor terminal of claim 2, wherein contacts are branched from a base end part on a rear side of the side plate.

4. A shield connector, comprising:

a shield terminal including the outer conductor terminal of claim 2, an inner conductor terminal and a dielectric interposed between the outer conductor terminal and the inner conductor terminal; and a connector housing for accommodating the shield terminal.

5. A shield connector, comprising:

a shield terminal including the outer conductor terminal of claim 1, an inner conductor terminal and a dielectric interposed between the outer conductor terminal and the inner conductor terminal; and a connector housing for accommodating the shield terminal.

* * * * *